United States Patent [19]

Heberle

[11] 3,967,601

[45] July 6, 1976

[54] VALVE CONTROL

[75] Inventor: Hansjörg Heberle, Ludwigshafen, Germany

[73] Assignee: Motoren- und Turbinen-union Friedrichshafen GmbH, Friedrichshafen, Germany

[22] Filed: Aug. 7, 1975

[21] Appl. No.: 602,786

[30] Foreign Application Priority Data

Sept. 7, 1974 Germany ..... 2442969

[52] U.S. Cl. ..... 123/90.4; 123/90.39; 123/90.41

[51] Int. Cl.[2] ..... F01L 1/18

[58] Field of Search ..... 123/90.39, 90.4, 90.41, 123/90.42, 90.47

[56] References Cited

UNITED STATES PATENTS

| | | | |
|---|---|---|---|
| 2,619,078 | 11/1952 | Witzky | 123/90.41 |
| 2,769,434 | 11/1956 | Witzky | 123/90.39 |
| 3,418,984 | 12/1968 | Skatsche | 123/90.39 |
| 3,428,032 | 2/1969 | Rudert | 123/90.4 |

*Primary Examiner*—Charles J. Myhre
*Assistant Examiner*—Daniel J. O'Connor
*Attorney, Agent, or Firm*—Craig & Antonelli

[57] ABSTRACT

A valve control for internal combustion engines with four valves per cylinder arranged in the cylinder head which are actuated from a cam shaft by way of push rods and rocker arms supported in bearing brackets; the two valves disposed closer to the actuating side are thereby actuated by way of a common rocker arm or individual rocker arms while the rocker arms for the other two valves extend arcuately shaped about a respective one of the bearing brackets and one of the first two valves; each of these rocker arms is provided with a pivot pin and the centers of the pivot points of the push rods and valve shafts of these rocker arms are arranged in a common plane disposed perpendicular to the axis of the respective pivot pin.

4 Claims, 2 Drawing Figures

VALVE CONTROL

The present invention relates to a valve control for internal combustion engines with four valves per cylinder arranged in the cylinder head, which are actuated from a cam shaft by way of push rods and rocker arms supported in two bearing brackets, whereby two individual rocker arms or a common rocker arm are coordinated to the two first valves disposed in proximity of the actuating side.

The aim of the present invention is the attainment of an arrangement of the rocker arms for such a valve control which is space-saving as possible. The construction of the rocker arms for the valves arranged remote from the push rod side is thereby rendered difficult by the more closely located, by valves, the rocker arms thereof and by further elements arranged in the cylinder center such as, for example, an injection nozzle or spark plug.

Solutions are known in the prior art in which the rocker arms for the remotely disposed valves are arranged above the more closely located valves and their rocker arms. This, however, requires additional structural space above the individual cylinders.

Furthermore, constructions are known in the prior art in which the rocker arms of the remotely arranged valves are extended about the more closely located valves. However, tilting forces result thereby with these prior art constructions which unilaterally load and stress the bearing support of the rocker arms and may cause a premature wear at the bearing places.

It is the aim of the present invention to avoid these disadvantages.

The underlying problems are solved according to the present invention in that the rocker arms for the other two valves are each extended arcuately shaped about a bearing bracket and about one of the first two valves, that each of these rocker arms is provided with a pivot pin and that the centers of the bearing points of the push rod and of the valve stem of these rocker arms and the center of the bearing place in the rocker arm bearing bracket are arranged in a common imaginary plane perpendicular to the axis of the bearing pin.

An extraordinarily compact, space-saving arrangement of the rocker arms is achieved by the present invention whereby, however, the bearing places of all rocker arms are loaded completely uniformly, whence one-sided and premature wear is avoided.

Figure 1:
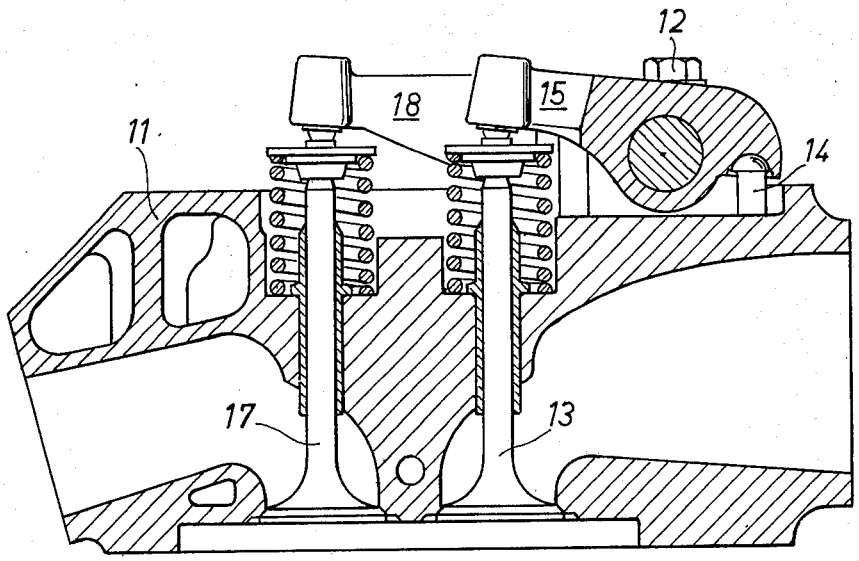
Figure 2:
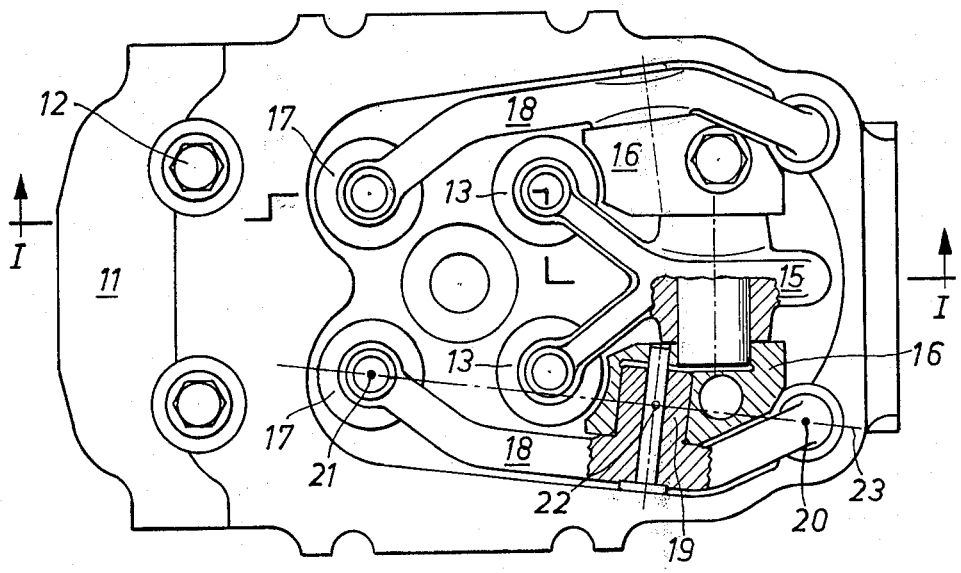

These and further objects, features and advantages of the present invention will become more apparent from the following description when taken in connection with the accompanying drawing which shows, for purposes of illustration only, one embodiment in accordance with the present invention, and wherein:

FIG. 1 is a longitudinal cross-sectional view through a cylinder head and valve-actuating mechanism in accordance with the present invention taken along line I—I of FIG. 2; and FIG. 2 is a plan view on the cylinder head of FIG. 1, with the cylinder head hood removed.

Referring now to the drawing wherein like reference numerals are used throughout the two views to designate like parts, the cylinder head 11 is secured by means of cylinder head bolts 12 on the cylinder-crankcase (not shown). Two valves 13, for example, the inlet valves which are located in proximity of or nearer the actuating side, are actuated by one of the three push rods 14 (FIG. 1) by way of a double rocker arm 15 (FIGS. 1 and 2) which is supported in two bearing brackets 16. Two further valves 17, for example, the exhaust valves, are actuated from two of the push rods 14 by way of two individual rocker arms 18, which are each extended arcuately shaped about a respective one of the bearing brackets 16 and about a respective one of the valves 13 and are provided with a bearing pin 19, by means of which the individual rocker arms 18 are supported in the bearing brackets 16. The centers 20 and 21 of the bearing points of the push rods of the valve stems and the centers 22 of the bearing places in the rocker arm brackets 16 are arranged in connection with both rocker arms 18, respectively in a common imaginary plane 23 perpendicular to the axis of the bearing pin 19.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A valve control for internal combustion engines with several valve means per cylinder arranged in the cylinder head which are actuated from a cam shaft by way of push rod means and rocker arm means supported in bearing bracket means, each valve means disposed nearer the actuating side being actuated by way of first rocker arm means, characterized in that each valve means disposed more remote from the actuating side is actuated by a further rocker arm means, each further rocker arm means extending arcuately shaped about a corresponding bearing bracket means and a first valve means, each of said further rocker arm means including a bearing pin means for pivotally supporting a further rocker arm means in a corresponding bearing bracket means, and the centers of the bearing points of the push rod means and valve stem means of said further rocker arm means and the center of the bearing place in the rocker arm bearing bracket means being arranged in a common plane disposed perpendicular to the axis of the bearing pin.

2. A valve control according to claim 1, characterized in that four valves are arranged in the cylinder head per each cylinder, two of said four valves being located closer to the actuating side and two valves being located further away from the actuating side, the two valves disposed further away from the actuating side being each actuated by a respective further rocker arm means.

3. A valve control according to claim 2, characterized in that the first two valves are actuated by a common rocker arm means.

4. A valve control according to claim 2, characterized in that the two first valves are actuated by two individual rocker arm means.

* * * * *